United States Patent [19]

Featherston

[11] 4,450,955

[45] May 29, 1984

[54] CARD HOLDER

[75] Inventor: Elmer F. Featherston P.O. Box 4, 4981 Mt. Hope Rd., Grass Lake, Mich. 49240

[21] Appl. No.: 327,407

[22] Filed: Dec. 4, 1981

[51] Int. Cl.[3] ..... A45C 11/18

[52] U.S. Cl. ..... 206/39.6; 150/39; 40/16

[58] Field of Search ..... 150/39; 260/39.6, 39.5, 260/39; 40/16, 17

[56] References Cited

U.S. PATENT DOCUMENTS

| | | | |
|---|---|---|---|
| 2,090,856 | 8/1937 | Umansky | 40/18 |
| 2,362,273 | 11/1944 | Hopp | 40/16 UX |
| 2,647,071 | 7/1953 | Schade . | |
| 2,725,913 | 12/1955 | Horwin | 150/39 |
| 4,141,400 | 2/1979 | Mangan | 150/39 |

*Primary Examiner*—Donald F. Norton
*Attorney, Agent, or Firm*—Beaman & Beaman

[57] ABSTRACT

The invention pertains to a protective holder for information bearing cards, such as credit cards, wherein the card includes a magnetic strip affixed to the rear face upon which information is magnetically stored. The holder comprises a substantially flat body having folded-over lips at the upper and lower lateral edges which define pockets for receiving the lateral edges of the card. Adjacent at least one of the holder lateral edges is a card supporting surface projecting beyond the primary body surface of the holder which maintains a spacing between the rear of the card and the body surface to prevent contact of the card magnetic strip and holder and protect the strip.

8 Claims, 5 Drawing Figures

CARD HOLDER

BACKGROUND OF THE INVENTION

Information bearing cards are widely used for credit, fare and informational purposes, and it is common to locate the information bearing indicia upon magnetic strips attached to the card rear face. As such cards are carried in purses and billfolds, and repeatedly handled, the cards become bent, dirty, scratched, and otherwise damaged, and the magnetic strip often becomes damaged to the extent wherein the card is no longer useable to its intended purpose. The information indicia is magnetically stored upon the magnetic strips, and scratches and abrasions upon the strip can adversely affect the readability and interpretation of the information stored thereon as electronically sensed.

In order to protect information bearing cards utilizing magnetic strips a wide variety of card holders are available for use in pocket or purse, and while such holders provide greater protection than loosely carrying the card, holders specially designed to protect the magnetic strip have not been widely available, or used.

Card holding devices are known, such as shown in U.S. Pat. Nos. 2,090,856; 2,647,071 and 2,725,913, and the protective holder shown in U.S. Pat. No. 4,141,400 is especially designed to protect a card having a magnetic strip. However, protective card holders of the type previously known are either too expensive, bulky, or difficult to use, to be widely acceptable.

It is an object of the invention to provide a holder for information bearing cards which adds little bulk to the card, and may be readily utilized without requiring unusual handling or dexterity.

Another object of the invention is to provide a protective holder for information bearing cards wherein the holder may be economically produced, and the front face of the card is substantially fully visible while mounted in the holder permitting the card and holder to be filed and stored.

A further object of the invention is to provide a protective holder for information bearing cards utilizing a magnetic strip upon the reverse face wherein the magnetic strip is spaced from the holder structure to prevent abrasion and wear due to contact with the holder.

Another object of the invention is to provide a protective holder for information bearing cards wherein the holder and card may be used together in permanent files, or readily carried in purse or pocketbook, and in any use provides protection for information bearing magnetic strips attached to the card rear face.

Yet another object of the invention is to provide a protective holder for information bearing cards formed of a synthetic plastic extrusion, and wherein the holder includes means for firmly retaining the card therein, yet permits the card to be readily removed from the holder.

In the practice of the invention the card holder is formed of a synthetic plastic extrusion to define a body which includes a substantially flat primary wall portion having end edges and parallel lateral edges along the upper and lower regions of the body. The lateral edges each include a lip formed of the body material which is folded over 180° to define a cantilevered lip superimposed over the flat wall portion, and spaced therefrom, wherein the lips each define an elongated pocket which is open at each end of the holder body. The pockets are spaced from each other a distance to permit reception of the upper and lower edges of a conventional information bearing card, such as a credit or fare card, and the "thickness" of the pockets is such to firmly engage the card to frictionally maintain the assembly of the card and holder, and yet permit the card to be readily slipped from the confines of the holder.

Adjacent at least one of the lateral edges of the holder, and preferably located within a lateral edge pocket, is a card supporting projection in the form of a raised shoulder which engages the rear face of a card located within the holder adjacent the card lateral edge nearest the magnetic strip attached to the card rear face. The purpose of the shoulder surface is to hold the portion of the rear face of the card upon which the magnetic strip is located away from the body wall portion to protect the magnetic strip against contact and abrasion with the holder during insertion or removal of the card with respect to the holder, and while the card is stored therein.

The card is placed within the holder by inserting the card lateral edges within the holder pockets, and longitudinally sliding the card with respect to the holder. Removal of the card from the holder is, likewise, accomplished by sliding the card lengthwise with respect to the holder and pockets. Preferably, finger notches are defined in the end edges of the holder to facilitate grasping of the card for removal or insertion into the holder.

The shouldered surface for supporting the card rear face out of engagement with the body wall need only be located adjacent one of the holder lateral edges as long as the card is always inserted into the holder with the magnetic strip located adjacent the holder lateral edge having the shoulder surface. However, it is within the scope of the invention to locate a shouldered surface at each lateral edge of the holder, i.e. adjacent each holder pocket, and such a modification does not change the basic inventive concepts.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
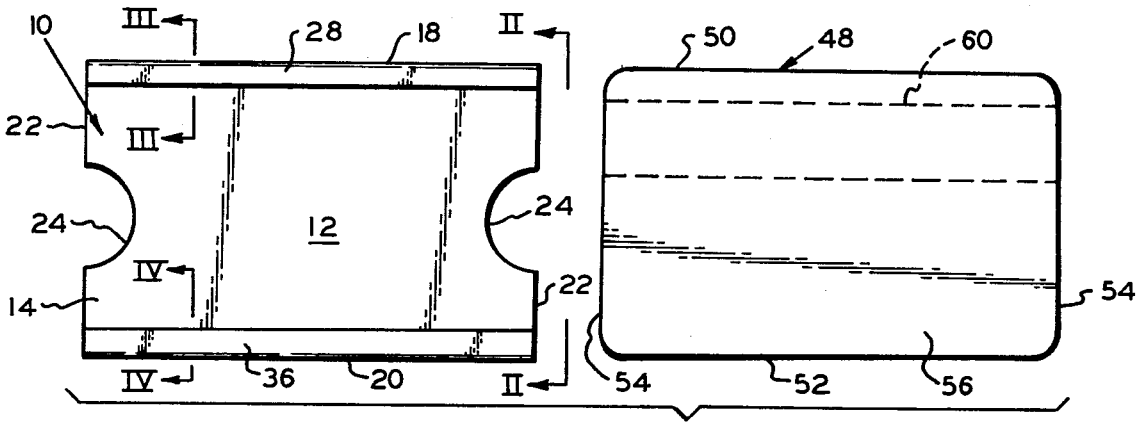
FIG. 1 is an elevational view of the holder, illustrating a typical information bearing card in alignment therewith prior to insertion into the holder.
Figure 2:
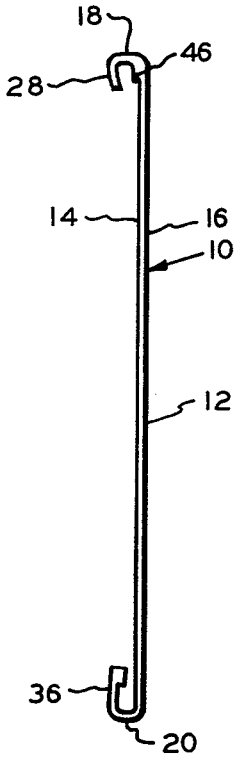
FIG. 2 is an enlarged end view of the holder as taken along Section II—II of FIG. 1.

The overall appearance of the protective card holder in accord with the invention will best be appreciated from FIGS. 1 and 2. The holder comprises a synthetic plastic body 10, readily formed as an extrusion, wherein an elongated extruded strip having the cross sectional configuration of the holder is severed into the desired lengths to form a plurality of bodies 10 on a high production basis.

The holder body 10 includes a flat wall portion 12 having a flat inner surface 14, and a flat outer surface 16. Further, the body 10 includes an upper lateral edge 18, a lower lateral edge 20, and linear end edges 22 which are notched at 24 to facilitate grasping of a card within the holder, as will be later apparent.

The lateral edges 18 and 20 are parallel to each other, and are each defined by a folded-over lip portion which forms an elongated open-ended pocket. The upper lateral edge 18 includes a portion 26 transversely disposed to the plane of the wall portion 12, and the cantilevered lip 28 extends downwardly from the portion 26, and the lip end 30 is disposed obliquely "back" toward the plane of the wall portion. Thus, the lip 28 defines a pocket 32 opening downwardly which receives the upper edge of the card to be held, as later described.

The lower lateral edge 20 includes a portion 34 transversely disposed to the plane of the wall portion 12, and the cantilevered lip 36 extends upwardly from the portion 34 terminating in the free end 38. The lip 36 includes inner surface 40 upon which the elongated rib 42 is defined which projects from the inner surface toward the wall portion 12. It will be appreciated that the lip 36 and wall portion define an elongated open-ended lower pocket 44.

Figure 3:
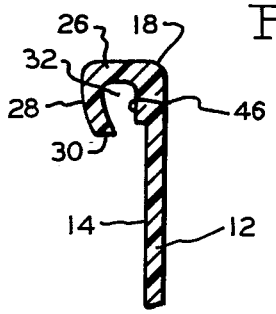
FIG. 3 is an enlarged, elevational, sectional, detail view of the upper holder lateral edge as taken along Section III—III of FIG. 1.
Figure 4:
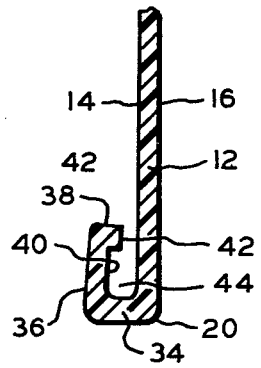
FIG. 4 is an enlarged, elevational, detail, sectional view of the lower holder lateral edge as taken along Section IV—IV of FIG. 1.

The upper region of the body 10, adjacent the upper lateral edge 18, includes a card supporting surface for holding the upper portion of the card in spaced relationship to the wall portion 12. In the preferred arrangement this card supporting projection comprises a shoulder surface 46, FIG. 3, located adjacent the edge 18 within the upper pocket 32. The shoulder surface 46 extends from the plane of the wall portion inner surface 14 a distance at least equal to, and preferably greater than, the distance that a magnetic strip protrudes from the rear face of the information bearing card retained within the holder. The surface 46 is of an elongated form extending throughout the length of the body 10, as formed during the extrusion thereof, and is spaced from the inner surface of the lip 28 and end 30 a distance slightly greater than the thickness of the information bearing card to be held within the holder.

Figure 5:
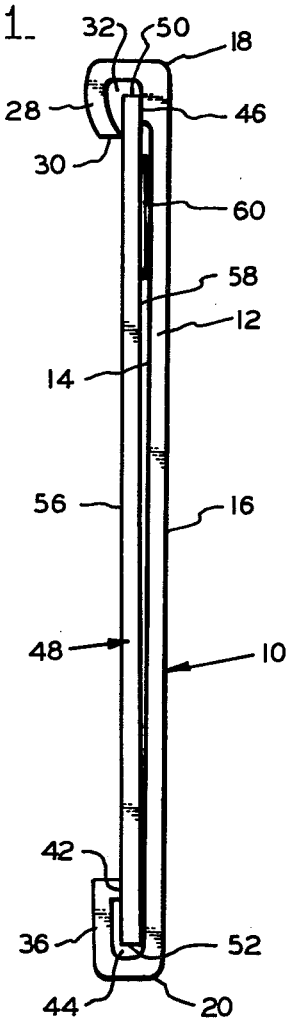
FIG. 5 is an enlarged end view of the holder of the invention with an information bearing card mounted therein.

The type of information card 48 with which the holder of the invention is utilized is shown at the right in FIG. 1, and is also represented in FIG. 5 as associated with the holder. The card is of a rectangular form having a flat body defined by an upper edge 50, a lower edge 52, and parallel end edges 54. The card includes a flat front face 56, a flat rear face 58, and a magnetic tape strip 60 is attached to the rear face of the card usually extending the length thereof, and disposed adjacent the upper edge 50 in parallel relationship thereto. The magnetic strip 60 constitutes the storage for magnetic information bearing portions whereby the strip may be "read" by conventional magnetic tape reading apparatus. Information bearing cards of the aforedescribed type are widely used in financial transactions as credit cards, transit fare cards, and for computerized accounting purposes.

To place the information bearing card 48 within the holder body 10 the card and holder are aligned in an end-to-end relationship. The alignment may be as shown in FIG. 1 wherein the upper and lower lateral edges of the card and holder are substantially aligned, or the lower edge 52 of the card adjacent the left edge 54 may be placed within the holder lower pocket 44 adjacent end 22, initially, and the card pivoted upwardly to insert the card upper edge 50 into the upper holder pocket 32. Once the upper and lower edges of the card are located within the holder upper and lower pockets 32 and 44, respectively, the card is slid within the pockets to substantially align the end edges of the card and holder wherein the card rear face 58 will be in superimposed relationship to the holder wall portion inner surface 14.

As will be appreciated from FIG. 5, the rear face of the card adjacent the upper edge 50 engages the holder shoulder surface 46 causing the upper portion of the card to be "tilted" forwardly with respect to the holder wall portion 12. This "tilting" of the card 48 within the holder produces sufficient clearance and spacing between the upper portion of the card rear face 58 and the holder inner surface 14 to prevent engagement of the magnetic strip 60 with the body inner surface 14, thereby preventing scratching and abrasion to the magnetic strip while it is being inserted into the holder, or removed therefrom.

The thickness of the pocket 32 is, preferably, slightly greater than the thickness of the card 48, while the "thickness" of the lower pocket 44 as defined by the distance between the rib 42 and the opposed portion of the body inner surface 14, is slightly less than the card thickness. Thus, a frictional engagement exists between the card and the holder within the pocket 44 preventing the card from accidentally slipping from the holder. However, the frictional engagement of the card as determined by the natural resiliency of the lip 36 does not produce such a force as to render insertion and removal of the card from the holder difficult.

With the card 48 assembled to the holder body 10 in the manner described above, the magnetic strip 60 is fully protected by the holder wall portion 12, and cannot be damaged even though the assembled card and holder are loosely carried within a pocket or purse. Further, as the lips 28 and 36 are of short length, the lip 36 being slightly longer than the lip 28, they "cover" only the marginal upper and lower edge regions of the card thereby permitting the front face 56 of the card to be fully visible, which is important if the assembled holder and card are stored within drawers or racks for accounting purposes.

The finger notches 24 aid in grasping the card for removing the same from the holder, however, these finger notches are not required. Also, it is anticipated that logos, advertising material, or similar indicia will be imprinted upon the body inner surface 14 for advertising and promotional purposes, which will aid the user in determining the orientation of the holder upper and lower edges.

In the disclosed embodiment only a single shoulder surface 46 is illustrated, i.e. adjacent the body upper lateral edge 18. However, it is within the scope of the invention to locate a similar card supporting shoulder surface within, or adjacent, the lower pocket 44 wherein specific orientation of the card to the holder is not required to insure that the card magnetic strip will be spaced from the body inner surface 14. Also, a variety of lip configurations, and pocket forms, could be utilized, and it is appreciated that further modifications to the disclosed embodiment may be apparent to those skilled in the art without departing from the spirit and scope of the invention.

I claim:

1. A holder for information bearing cards having front and rear faces, first and second lateral edges and a magnetic strip attached to the rear face adjacent and spaced from the card first lateral edge and substantially parallel thereto comprising, in combination, a substantially rigid body having a substantially flat wall portion defined by inner and outer surfaces, end edges and substantially parallel first and second lateral edges, said first body lateral edge including a lip folded over and spaced from the adjacent wall portion inner surface defining an open end elongated first pocket, said second body lateral edge including a lip folded over and spaced from the adjacent wall portion inner surface defining an open end elongated second pocket, a card support projection defined on said wall portion inner surface adjacent said first body lateral edge and in opposed relation to said first body lateral edge lip extending from said inner surface toward said first body lateral edge lip a distance at least as great as the distance the magnetic strip protrudes from the card rear face, said first and second pockets receiving the card first and second lateral edges, respectively, to retain the card within said holder body wherein the card rear face is disposed in opposed relation to said wall portion inner surface, the card front face is visible substantially in its entirety, and said projection engages the card rear face adjacent the card first lateral edge to hold the card rear face from engagement with said body inner surface adjacent the card first lateral edge to protect the card magnetic strip.

2. In a holder for information bearing cards as in claim 1, said card support projection comprising a shoulder defined upon said wall portion adjacent said body first lateral edge.

3. In a holder for information bearing cards as in claim 2 wherein said support projection shoulder comprises an elongated continuous shoulder surface extending between said body end edges.

4. In a holder for information bearing cards as in claim 1 wherein the width of said second pocket in a direction perpendicular to the plane of said wall portion is substantially equal to the card thickness whereby said second pocket firmly receives the card second lateral edge.

5. In a holder for information bearing cards as in claim 1 wherein said body is formed of a synthetic plastic material.

6. In a holder for information bearing cards as in claim 1 wherein said body second lateral edge lip includes a free end and an inner surface in opposed relation to said wall portion inner surface, an elongated rib defined on said lip inner surface adjacent said free end extending into said second pocket adapted to engage a card front face adjacent the second lateral edge thereof.

7. In a holder for information bearing cards as in claim 1, a notch defined in at least one of said body end edges to facilitate the grasping of a card retained upon said holder body.

8. In a holder for information bearing cards as in claim 1 wherein said body comprises a section of synthetic plastic extrusion.

* * * * *